United States Patent [19]

MacKinnon et al.

[11] Patent Number: 4,882,820

[45] Date of Patent: Nov. 28, 1989

[54] TENTER FRAME CHAIN WITH LOW FRICTION SLIDE BLOCK

[75] Inventors: Francis X. MacKinnon, N. Scituate; James F. Horn, Cranston; John A. Pastina, Warwick, all of R.I.

[73] Assignee: Gessner Industries, Inc., Charlotte, N.C.

[21] Appl. No.: 326,523

[22] Filed: Mar. 21, 1989

[51] Int. Cl.[4] ..... D06C 3/02

[52] U.S. Cl. ..... 26/93; 26/95; 26/89

[58] Field of Search ..... 28/93, 94, 95, 96, 89

[56] References Cited

U.S. PATENT DOCUMENTS

| | | |
|---|---|---|
| 2,472,375 | 6/1949 | Hinnekens . |
| 3,500,515 | 3/1970 | Cunningham et al. . |
| 4,103,403 | 8/1978 | Parrillo et al. . |
| 4,134,189 | 1/1979 | Richter . |
| 4,545,098 | 10/1985 | Schroer . |
| 4,558,496 | 12/1985 | Cramer . |

FOREIGN PATENT DOCUMENTS

| | | | |
|---|---|---|---|
| 0138117 | 4/1985 | European Pat. Off. | 26/93 |
| 1039018 | 9/1958 | Fed. Rep. of Germany . | |
| 1066983 | 10/1959 | Fed. Rep. of Germany . | |
| 2028392 | 3/1980 | United Kingdom . | |

*Primary Examiner*—Werner H. Schroeder
*Assistant Examiner*—Jodi Tokar
*Attorney, Agent, or Firm*—Bell, Seltzer, Park & Gibson

[57] ABSTRACT

The present tenter frame chain includes a plurality of links, each link including upper and lower interconnected loadbearing plates, and a low friction slide block sandwich between the upper and lower interconnected plates. The slde block is formed of material having a lower coefficient of friction than the interconnected loadbearing plates and includes a vertically disposed bearing surface located laterally outwardly beyond the lateral extent of one side of the upper and lower interconnected loadbearing plates. The vertically disposed bearing surface of the slide block contacts the bearing surface of the guide rail to reduce the frictional rubbing movement of the tenter chain against the vertically disposed bearing surface of each of the tenter chain guide rails as the tenter chain moves therealong.

17 Claims, 3 Drawing Sheets

TENTER FRAME CHAIN WITH LOW FRICTION SLIDE BLOCK

FIELD OF THE INVENTION

This invention relates generally to a tenter frame chain formed of links having reduced frictional contact with the guide rail of a tenter frame, and more particularly to such a chain in which the links include a low friction slide block sandwiched between and extending outwardly beyond opposite sides of upper and lower interconnected loadbearing plates to reduce the frictional rubbing movement of the forward run of the tenter chain against the bearing surface of the guide rail.

BACKGROUND OF THE INVENTION

Tenter frames are used by the textile industry in the drying or heat setting of fabrics as the fabric is conveyed through a high temperature dryer. The opposite side edge portions of the fabric are carried through the dryer by a pair of tenter chains with the forward runs of the tenter chains being guided along and rubbing against vertically disposed bearing surfaces of each of the guide rails. Tenter clips or the like are carried by the chain and grip the fabric to stretch it between the spaced-apart tenter chains. The tenter chains carry the fabric through the dryer at a high rate of speed so that substantial frictional forces are generated by the rubbing motion of the tenter chain against the guide rails.

It is the common practice to apply lubricant along the areas of engagement between the tenter chain and the guide rails to reduce wear and to prevent the build-up of excessive heat generated by the frictional forces. Special types of greases, oils, graphite, and other lubricants have been developed to provide the proper amount of lubrication and to prevent staining of the fabric by the lubricant employed. These special types of lubricant are very expensive. Even with the use of these expensive types of lubrication, the friction is still not reduced to the point that the chain and guide rail are not subjected to excessive wear, and the fabric can become stained by the lubricants. If the lubricant contacts the fabric, the stains have a tendency to be set in the fabric by the high temperatures generated in the dryer.

In an attempt to reduce the amount of lubricant required, and to eliminate the problem of staining the fabric with large amounts of lubricant being applied, it has been proposed that various types of slide blocks or plates be carried along by the chain and/or the tenter clip for engagement with the guide rail and to thereby reduce the frictional rubbing engagement therewith. The wear plates heretofore employed have been either of the hard, wear-resistant material type or of a low friction type material. It is also known to provide roller bearings on the chain clip support members and/or the tenter chain in an attempt to reduce frictional wear and to reduce the amount of lubricant which must be applied to the tenter chains. In some instances, both the use of rollers and wear plates or strips have also been suggested. However, in each of these instances, the use of wear strips and/or friction reducing rollers requires considerable modification of the construction of the guide rails and/or the tenter chains and the replacement of the wear plates and/or rollers can be expensive and time consuming.

SUMMARY OF THE INVENTION

With the foregoing in mind, it is an object of the present invention to provide a tenter frame chain having a plurality of links with each link including upper and lower interconnected loadbearing plates, and a slide block sandwiched between the loadbearing plates and having a vertically disposed bearing surface located laterally outwardly beyond the lateral extent of the loadbearing plates for contacting the vertically disposed bearing surface of the guide rail, while maintaining other portions of the tenter chain spaced out of contact with the bearing surface of the guide rail. The slide block is sandwiched between the loadbearing plates in such a manner that the slide block can be easily exchanged, should it become worn, in an economical and expedient manner.

In accordance with the present invention, the slide block is formed of a low friction material and is maintained in a fixed position sandwiched between the spaced-apart upper and lower loadbearing plates of the tenter chain. The slide block is sandwiched between the loadbearing plates with a vertically disposed bearing surface of the slide block projecting laterally outwardly beyond the outer surface of one side of the upper and lower loadbearing plates so that the vertically disposed bearing surface of the slide block reduces the frictional rubbing movement of the tenter chain against the vertically disposed bearing surface of the guide rail as the slide block rides along in engagement with the guide rail.

In a preferred form, the slide block is formed of sintered metal with a suitable lubricant impregnated therein. Opposite end portions of each of the chain links include vertical holes extending therethrough to accommodate chain studs which extend through the vertical holes to maintain the slide block in position sandwiched between the upper and lower loadbearing plates. The medial portion of the slide block includes an elongate vertical hole extending therethrough to reduce the overall weight of the slide block. A split bearing insert sleeve extends through the vertical holes at opposite ends of the slide block and also extends into the holes in the spaced-apart upper and lower loadbearing plates to resiliently maintain the chain links in assembled condition.

The vertically disposed bearing surface on one side of the slide block is planar and the opposite side of the slide block has a concave surface to facilitate movement of the chain around the sprockets supporting the tenter chain for movement along the guide rail. The longitudinal stress applied to the tenter chain links is absorbed by the upper and lower loadbearing plates, which are formed of steel, while the sintered metal slide block sandwiched between the loadbearing plates serves to reduce the frictional rubbing movement of the tenter chain against the vertically disposed bearing surface of the guide rail.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
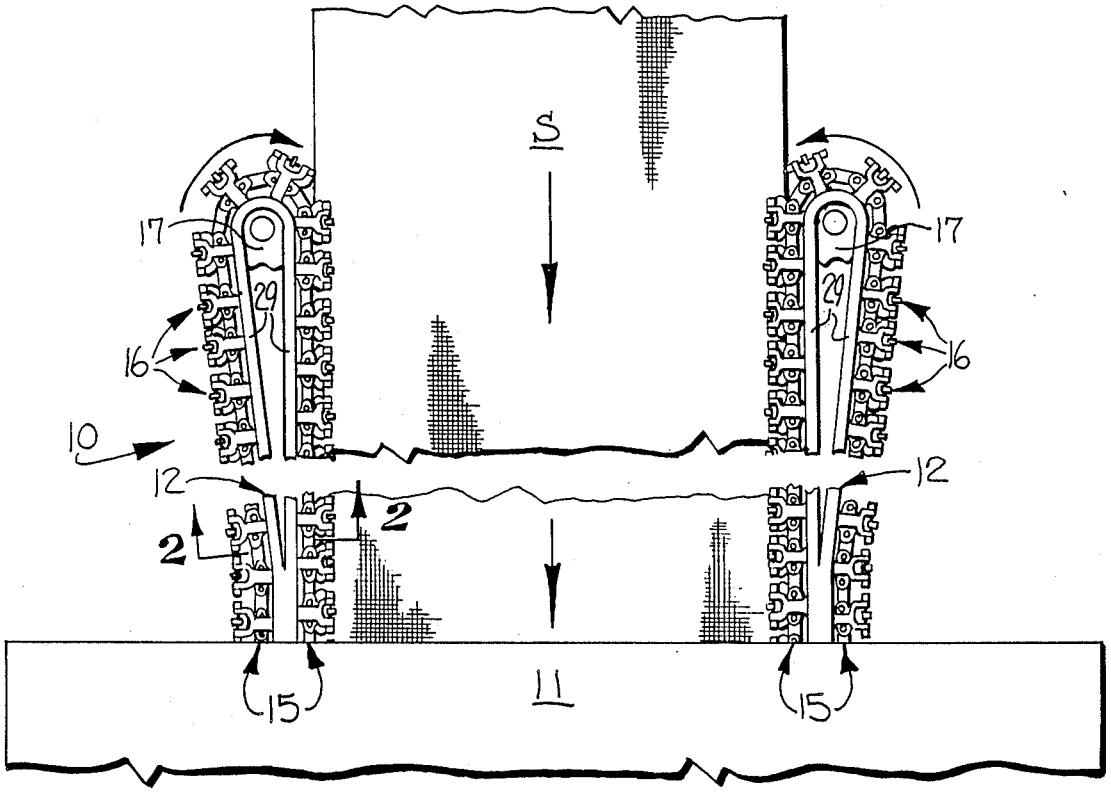
FIG. 1 is a fragmentary top plan view of one end of a tenter frame and illustrating the spaced-apart tenter chains moving the fabric into the drying oven.

As illustrated in FIG. 1, the tenter frame, broadly indicated at 10, is provided for transporting sheet material S, such as textile fabric, under tension and in an open width condition along a longitudinal path of travel through a conventional dryer 11. The tenter frame 10 includes a pair of spaced-apart and parallel guide rails, broadly indicated at 12, extending along opposite sides of the longitudinal path of travel of the textile fabric S. An endless tenter chain, broadly indicated at 15, is supported for movement in each of the guide rails 12 and carries fabric engaging clip means, broadly indicated at 16, for engaging opposite sides of the sheet material S and for conveying the sheet material through the oven 11 in an open width condition. Opposite ends of the endless tenter chains 15 extend around driving sprocket members 17 with the tenter clips 16 extending along the forward run of the tenter chain 15 in gripping engagement with the opposite side edge portions of the textile fabric S.

Figure 2:
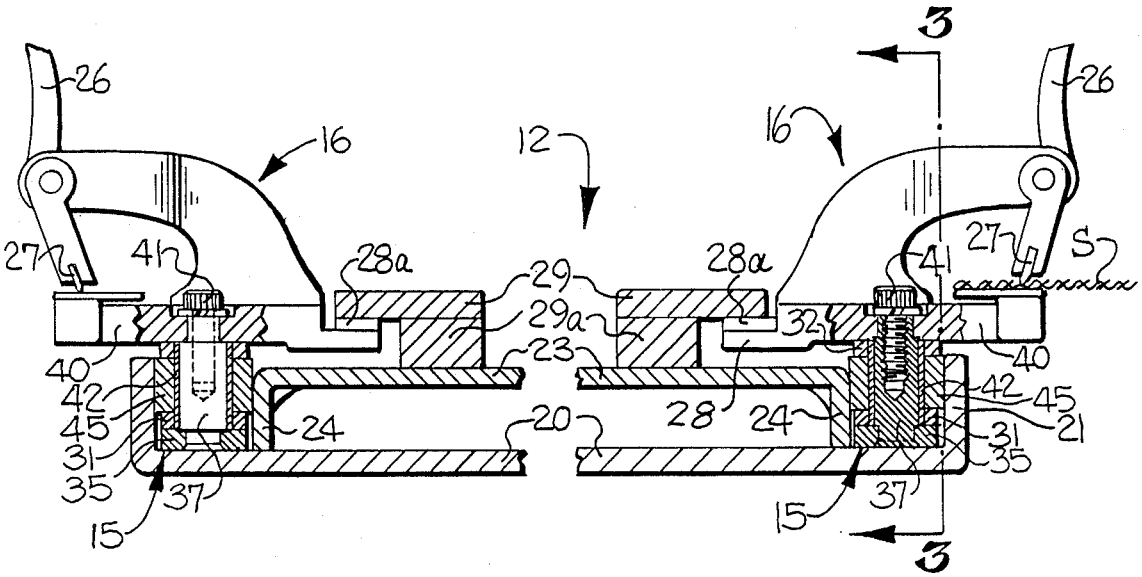
FIG. 2 is an enlarged vertical sectional view through one of the tenter chains, being taken substantially along the line 2—2 in FIG. 1.
Figure 4:
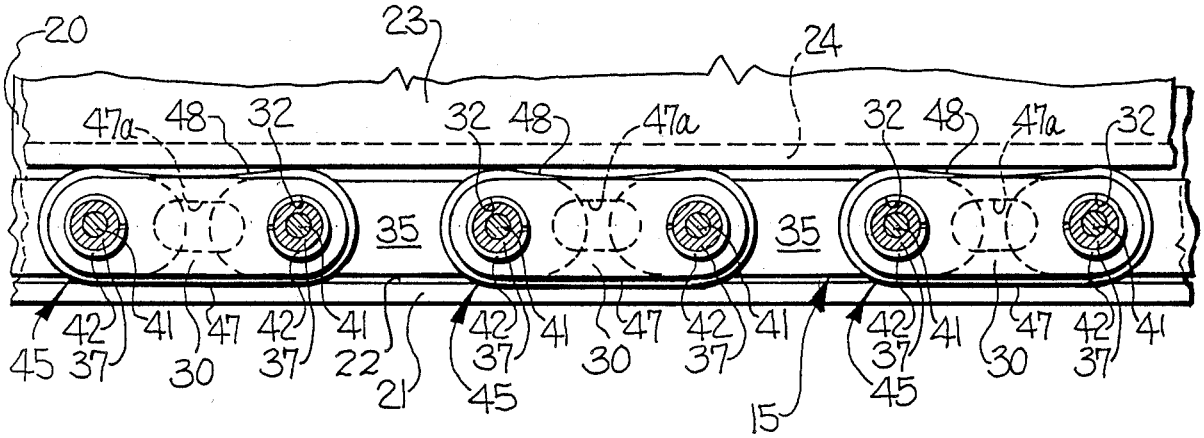
FIG. 4 is a fragmentary sectional plan view taken substantially along the line 4—4 in FIG. 3.

As shown in FIG. 2, each of the guide rails 12 includes a U-shaped channel guide 20 having upturned inner and outer legs 21 and forming a vertically disposed inner bearing surface 22 (FIG. 4) extending along the corresponding sides of the longitudinal path of travel of the textile material S. An inverted U-shaped channel member 23 is supported on the channel member 20 and has downturned inner and outer legs 24. The legs 21 and 24 provide a guide channel therebetween and in which the tenter chain 15 is guided. The forward and rearward runs of the endless tenter chains 15 are supported for movement in each of the guide rails 12 for movement along the guide channel formed between the legs 21 of the lower channel member 20 and the legs 24 of the upper channel member 23. The textile fabric S is moved along in stretched condition by the clip members 16 on the forward runs of each of the tenter chains 12. The clip members 16 each include a pivoted clamping lever 26, the lower end of which includes a fabric clamping blade 27 positioned against the upper surface of the outer side edge portion of the textile fabric S (FIG. 2). Thus, the stretched textile fabric S pulls the outer surface of the forward run of the chain 15 against the vertically disposed bearing surface 22 on the inner surface of the leg 21 of the guide rail 12.

The inner portion of the chain clip 16 includes a horizontally disposed support plate 28 having a slide plate 28*a* fixed thereon. The slide plate 28*a* rides along the lower surface of a support rail 29 which is maintained in position by a spacer rail 29*a* fixed between the support rail 29 and the channel member 23. The slide plate 28*a* maintains the chain clip 16 in the horizontal position shown in FIG. 2 as the tenter chain 15 rides along in the guide channel formed in the guide rail 12.

Figure 5:
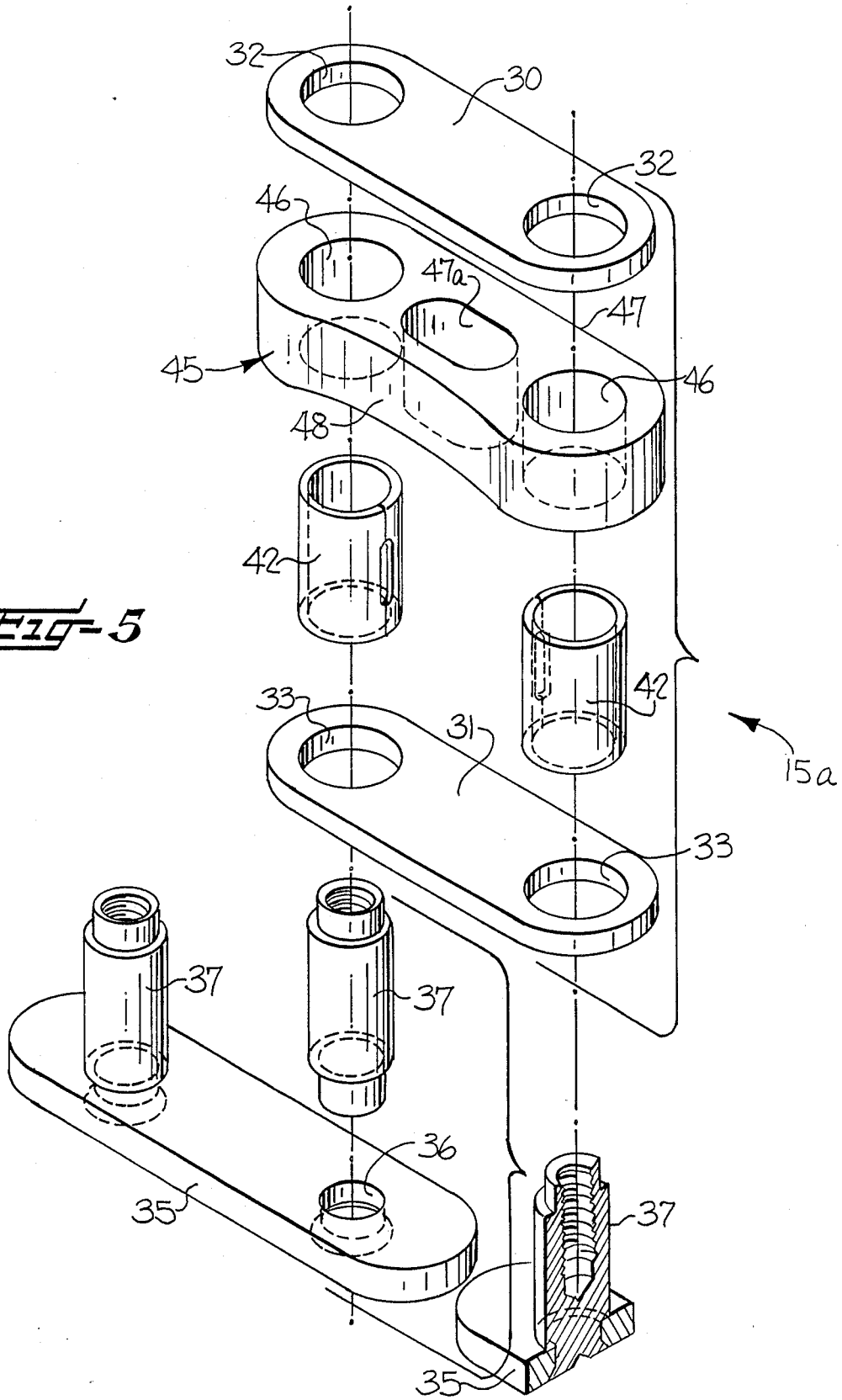
FIG. 5 is an exploded isometric view illustrating the manner in which the slide block of the present invention is sandwiched between the upper and lower interconnected loadbearing plates of a tenter chain link.

As illustrated in FIGS. 2–5, the tenter chain 15 includes a plurality of chain links, broadly indicated at 15*a* in FIG. 5. Each chain link 15*a* includes respective spaced-apart upper and lower elongate interconnected loadbearing plates 30, 31. The loadbearing plates 30, 31 are formed of steel and are provided with respective vertical holes 32, 33 extending through opposite end portions thereof (FIG. 5). Opposite end portions of elongate chain shoe plates 35 are positioned beneath the opposite ends of the lower loadbearing plates 31 and include vertical holes 36 provided adjacent opposite ends thereof. The holes 36 support the lower shouldered ends of vertically extending chain studs 37 therein. The lower end of each of the chain studs 37 is maintained in the elongate chain shoe plate 35 by expanding the lower end of the chain stud 37 to fill in a slight countersink in the lower end of the vertical hole 36.

Figure 3:
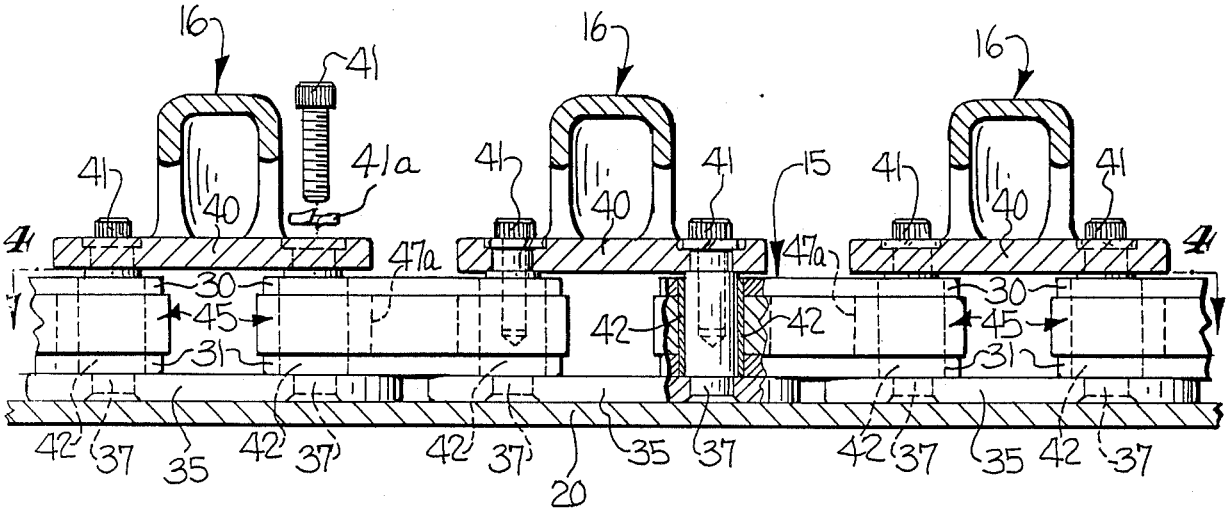
FIG. 3 is a fragmentary vertical sectional view taken substantially along the line 3—3 and showing a portion of the tenter chain in elevation.

The vertically extending chain studs 37, extending upwardly from each of the elongate chain shoe plates 35, are connected together at their upper ends by a base plate 40 formed on the tenter clip 16. As illustrated in FIG. 3, a cap screw 41, provided with a lock washer 41*a*, extends through a vertical opening in the base plate 40 and is threadably embedded in the upper end of the chain stud 37 to maintain the clips 16 in position on the tenter chain 15 and to interconnect adjacent pairs of the chain links 15*a*.

Split bearing insert sleeves 42 (FIG. 5) are resiliently maintained at their upper and lower ends in the vertical holes 32, 33 of the corresponding loadbearing plates 30, 31. A slide block 45 is maintained in a fixed position and extends between the spaced-apart upper and lower elongated interconnected loadbearing plates 30, 31. The slide block 45 is maintained in position sandwiched between the interconnected loadbearing plates 30, 31 by means of vertical holes 46 positioned in and extending through adjacent end portions thereof. The vertical holes 46 are of sufficient diameter to encircle the bearing insert sleeves 42 when the upper and lower loadbearing plates 30, 31 are resiliently engaged in the corresponding upper and lower ends of the bearing insert sleeves 42 so that the upper and lower loadbearing plates 30, 31 and the slide block 45 are resiliently maintained in assembled condition, by means of the bearing insert sleeves 42.

An elongate vertical hole 47*a* is provided in the medial portion of the slide block 45 and positioned between the vertical holes 46 to reduce the overall weight of the slide block 45. The slide block 45 includes a vertically disposed planar bearing surface 47 (FIGS. 3 and 4) extending along one side thereof and located laterally outwardly beyond the lateral extent of one side of the upper and lower elongated loadbearing plates 30, 31. The opposite side of the slide block 45 is provided with a concave face 48 (FIGS. 4 and 5) which is positioned on the inner portion of the endless tenter chain 15 to aid in movement of the chain around the sprockets 17. Since the loadbearing plates 30, 31 are formed of steel, they, along with the chain shoe links 35 and the tenter clip base plate 40, absorb the longitudinal stress applied to the tenter chain 15 and longitudinal stress is not imposed on the slide blocks 45 sandwiched between the tenter chain links.

As illustrated in FIGS. 3 and 5, the planar bearing surface 47 of the slide block 45 spans the entire distance between the upper and lower loadbearing plates 30, 31 and provides a wide bearing surface. The height or thickness of the planar bearing surface 47 is slightly greater than three times the height or thickness of each of the upper and lower loadbearing plates 30, 31 to provide a wide inner bearing surface on the forward run of the tenter chain 15.

The slide block 45 is preferably formed of a material having a lower coefficient of friction than the loadbearing plates 30, 31 and is preferably formed of a sintered metal having a lubricant impregnated therein. While various types of low friction material may be used to form the slide block 45 to reduce the frictional rubbing movement of the forward run of the tenter chain against the vertically disposed bearing surface 22 of the guide rail 12, it has been found that a particular type of sintered metal greatly reduces the friction and permits a reduced amount of lubricant to be applied to the tenter chain. The particular type of sintered metal used is ASTM B 484-76 Type 3 Grade 1 Class C Nickel Steel MPIF-FN 0208. This material is heat treated and quenched and has a surface hardness of RC 28/32 and a particle hardness of RC 58/62.

In operation, the tenter chains 15 are assembled with the vertically disposed planar bearing surface 47 of each of the slide blocks 45 facing outwardly so that these planar vertically disposed bearing surfaces 47 of each of the slide blocks 45 engage the vertically disposed inner bearing surface 22 of the leg 21 of the channel 20 of the guide rail 12 as the forward run moves along the guide rail 12 and is forced inwardly into rubbing engagement therewith by the clips 16 engaging the outer edges of the textile fabric S. Should the vertically disposed planar bearing surface 47 of one or more of the bearing blocks 45 become worn to the extent that they need to be replaced, it is a simple operation to remove the screws 41 maintaining the base plates 40 of adjacent chain clips 16 in position and then raise the assembled upper plate 30, lower plate 31 and slide block 45. Either the upper or lower plate 30, 31 may then be removed from the bearing insert sleeve 42 to remove the slide block 45 and replace the same. Also, it may be desirable to have additional slide blocks 45 preassembled with interconnecting upper and lower plates 30, 31 and simply replace the assembled links in the proper position in the chain. Since the vertically disposed planar bearing surface 47 of each of the slide blocks 45 projects outwardly beyond the outer surface of one side of the upper and lower elongated interconnected loadbearing plates 30, 31, the vertically disposed planar bearing surface 47 acts to reduce the frictional rubbing movement of the forward run of the tenter chain 15 against the vertically disposed bearing surface 22 of the leg 21 of the channel 20 of the guide rail 12 to thereby permit a reduced amount of expensive lubricant to be used with the chain, even when running at an extremely high speed. By reducing the amount of lubricant required, the chance of staining the fabric with a lubricant is greatly reduced.

In the drawings and specification there has been set forth the best mode presently contemplated for the practice of the present invention, and although specific terms are employed, they are used in a generic and descriptive sense only and not for purposes of limitation, the scope of the invention being defined in the claims.

THAT WHICH IS CLAIMED IS:

1. A tenter frame for transporting sheet material under tension in an open width condition along a longitudinal path of travel, said tenter frame comprising a pair of elongate guide rails extending along opposite sides of the longitudinal path of travel of the sheet material, each of said guide rails having a vertically disposed bearing surface extending along the corresponding sides of the longitudinal path of travel of the sheet material, an endless tenter chain supported for movement in each of said guide rails with portions of the chain bearing against said vertically disposed bearing surface of said guide rail, and tenter clip means supported on said chain for engaging opposite sides of the sheet material, said tenter chain comprising a plurality of links, each link including upper and lower interconnected loadbearing plates and a slide block sandwiched between said loadbearing plates and having a vertically disposed bearing surface located laterally outwardly beyond the lateral extent of said loadbearing plates for contacting said vertically disposed bearing surface of said guide rail while maintaining other portions of the tenter chain spaced out of contact with the bearing surface of the said guide rail.

2. A tenter frame according to claim 1 wherein said slide block is formed of material having a lower coefficient of friction than said interconnected loadbearing plates.

3. A tenter frame according to claim 1 wherein said slide block is formed of sintered metal.

4. A tenter frame according to claim 3 wherein said sintered metal slide block includes lubricant impregnated therein.

5. A tenter frame according to claim 1 wherein a vertical hole is provided in each of said chain links adjacent each longitudinal end thereof, and wherein said tenter chain additionally includes connecting links located between and interconnecting adjacent pairs of said chain links, said connecting links including a chain shoe plate and a pair of studs projecting upwardly from said shoe plate and extending through the holes in adjacent chain links.

6. A tenter frame according to claim 5 wherein an elongated vertical hole extends through the medial portion of said slide block and between said vertical holes extending through opposite end portions of said slide block to reduce the overall weight of said slide block.

7. A tenter frame according to claim 5 including a bearing insert sleeve extending through said vertical holes of said chain links and interconnecting said upper and lower loadbearing plates to maintain the same in assembled condition in sandwiching relationship to said slide block.

8. A tenter frame according to claim 1 wherein said vertically disposed bearing surface of said slide block is planar, and wherein the side of said slide block opposite said vertically disposed bearing surface is concave.

9. A tenter frame according to claim 1 wherein said vertically disposed bearing surface of said slide block is planar, and wherein said vertically disposed bearing surface of said slide block is greater than three times as thick as the thickness of each of said upper and lower interconnected loadbearing plates.

10. A tenter frame for transporting sheet material under tension in an open width condition along a longitudinal path of travel, said tenter frame comprising a pair of elongate guide rails extending along opposite sides of the longitudinal path of travel of the sheet material, each of said guide rails having a vertically disposed bearing surface extending along the corresponding sides of the longitudinal path of travel of the sheet material, an endless tenter chain supported for movement in each of said guide rails with a forward run bearing against said vertically disposed bearing surface of said guide rail, and tenter clip means supported on said chain for engaging opposite sides of the sheet material, said tenter chain comprising a series of chain links, and connecting links located between and interconnecting adjacent chain links, said connecting links including a chain shoe plate and a pair of studs projecting upwardly from said shoe plate, and wherein a vertical hole is provided in each of said chain links adjacent each longitudinal end thereof receiving said studs therethrough, and each of said chain links including spaced-apart upper and lower elongated and interconnected loadbearing plates and a slide block in a fixed position and sandwiched between said spaced-apart upper and lower elongated interconnected loadbearing plates, said slide block being formed of material having a lower coefficient of friction than said interconnecting links, and said slide block including a vertically disposed planar bearing surface projecting outwardly beyond the outer surface of one side of said upper and lower elongated interconnected loadbearing plates whereby said vertically disposed bearing surface of said slide block reduces the frictional rubbing movement of said tenter chain against said vertically disposed bearing surface of each of said guide rails.

11. A chain link for the tenter chain of a tenter frame of the type having a guide rail with a vertically disposed bearing surface extending therealong with the chain being supported for movement along the guide rail in contact with the bearing surface, said chain link comprising upper and lower interconnected loadbearing plates, a slide block sandwiched between said loadbearing plates and having a vertically disposed bearing surface located laterally outwardly beyond the lateral extent of said loadbearing plates for contacting the vertically disposed bearing surface of the guide rail while maintaining other portions of the tenter chain spaced out of contact with the bearing surface of the guide rail.

12. A chain link according to claim 11 wherein said slide block is formed of material having a lower coefficient of friction than said interconnected loadbearing plates.

13. A chain link according to claim 11 wherein said slide block is formed of sintered metal.

14. A chain link according to claim 13 wherein said sintered metal includes lubricant impregnated therein.

15. A chain link according to claim 11 wherein said vertically disposed bearing surface of said slide block is planar, and wherein the side of said slide block opposite said vertically disposed bearing surface is concave.

16. A chain link according to claim 11 including vertically aligned holes in each end portion of each of said loadbearing plates and said slide block, and including a bearing insert sleeve through said vertically aligned holes to maintain the same in assembled condition with said slide block sandwiched between said loadbearing plates.

17. A chain link according to claim 11 wherein said vertically disposed bearing surface of said slide block is planar, and wherein said vertically disposed bearing surface of said slide block is greater than three times as thick as the thickness of each of said upper and lower interconnected loadbearing plates.

* * * * *